US010167590B2

(12) United States Patent
Heinz et al.

(10) Patent No.: US 10,167,590 B2
(45) Date of Patent: Jan. 1, 2019

(54) METHOD AND DEVICE FOR SORTING OF LAUNDRY ITEMS, PREFERABLY LAUNDRY ITEMS FOR CLEANING

(71) Applicant: Herbert Kannegiesser GmbH, Vlotho (DE)

(72) Inventors: Engelbert Heinz, Vlotho (DE); Wilhelm Bringewatt, Porta Westfalica (DE); Jürgen Sielermann, Heubach (DE); Peter Holtz, Bad Oeynhausen (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 15/689,801

(22) Filed: Aug. 29, 2017

(65) Prior Publication Data

US 2018/0057998 A1 Mar. 1, 2018

(30) Foreign Application Priority Data

Sep. 1, 2016 (DE) ..... 10 2016 010 519
Jan. 7, 2017 (DE) ..... 10 2017 000 084

(51) Int. Cl.
*D06F 93/00* (2006.01)
*B07C 5/16* (2006.01)
(Continued)

(52) U.S. Cl.
CPC ..... *D06F 93/00* (2013.01); *B07C 5/16* (2013.01); *B07C 5/3412* (2013.01); *B07C 5/3422* (2013.01)

(58) Field of Classification Search
CPC ..... D06F 93/00; D06F 95/00; B07C 5/342; B07C 5/3422
(Continued)

(56) References Cited

U.S. PATENT DOCUMENTS 3,581,887 A * 6/1971 Radutsky ..... D06F 93/00 209/546
4,450,073 A * 5/1984 Burnett ..... B07C 5/18 177/145
(Continued)

FOREIGN PATENT DOCUMENTS

DE 102008028120 A1 12/2009
DE 102013210996 A1 12/2014
(Continued)

OTHER PUBLICATIONS

European Patent Office, Europaischer Recherchenbericht (search in a related application), dated Jan. 10, 2017.

*Primary Examiner* — Terrell H Matthews
(74) *Attorney, Agent, or Firm* — Laurence P. Colton; Smith Tempel Blaha LLC

(57) ABSTRACT

The automatic sorting of laundry items requires a knowledge of all sorting criteria. One strives to read these out from data storage media attached to the laundry items. The problem is when laundry items lack data storage media, or they are not readable because they have been damaged, for example. The invention calls for deriving sorting criteria which cannot be otherwise obtained from at least one imaging recording of an imaging device, such as a 3D-camera. Such sorting criteria, which cannot be derived from the picture or recording of the 3D-camera, are derived from supplemental information which can be obtained in different ways. Thus, it is also possible to sort laundry items without data storage medium or with damaged data storage media in a fully automatic or at least largely automatic manner.

10 Claims, 2 Drawing Sheets

(51) Int. Cl.
*B07C 5/34* (2006.01)
*B07C 5/342* (2006.01)

(58) Field of Classification Search
USPC ..... 209/937
See application file for complete search history.

(56) References Cited

U.S. PATENT DOCUMENTS 4,744,035 A * 5/1988 Hashim ..... D06H 3/16 209/576
4,991,719 A * 2/1991 Butcher ..... B07C 5/3412 198/349.95
5,058,750 A * 10/1991 Gr se ..... B07C 5/3412 198/465.4
5,377,814 A * 1/1995 Smith ..... B07C 5/3412 198/465.4
5,388,706 A * 2/1995 Baldur ..... B07C 5/36 209/587
2012/0228340 A1* 9/2012 Sakane ..... D06F 89/02 223/37
2014/0267776 A1* 9/2014 Duthu ..... G06Q 10/087 348/169

FOREIGN PATENT DOCUMENTS

EP 0775771 A1 5/1997
EP 2113606 A2 * 11/2009 ..... D06F 93/00
EP 2113606 A2 11/2009
EP 2444544 A2 * 4/2012 ..... D06F 93/00
EP 2444544 A2 4/2012

* cited by examiner

METHOD AND DEVICE FOR SORTING OF LAUNDRY ITEMS, PREFERABLY LAUNDRY ITEMS FOR CLEANING

STATEMENT OF RELATED APPLICATIONS

This application claims priority on and the benefit of German Patent Application No. 10 2016 010 519.4 having a filing date of 1 Sep. 2019 and German Patent Application No. 10 2017 000 084.0 having a filing date of 7 Jan. 2017.

BACKGROUND OF THE INVENTION

Technical Field

The invention concerns a method for sorting of laundry items, preferably laundry items for cleaning, wherein the laundry items are transportable from at least one transport system to at least one identification station and are then taken to a sorting station and sorted therein. Furthermore, the invention concerns a device for sorting of laundry items, preferably laundry items for cleaning, with an identification station, a sorting station as well as a transport system for transporting the laundry items hanging on the transport system through the identification station and the sorting station.

Prior Art

The sorting of laundry items, especially those which are going to be washed or otherwise cleaned, is done usually by means of several sorting criteria. For example, the shape, the size, the kind, the colour, the fabric and/or the weight of the laundry items are sorting criteria. The sorting can be done with regard to single or also multiple sorting criteria, for example according to washing programs.

Thus far, laundry items which are going to be washed or otherwise cleaned, i.e., worn and/or soiled laundry items (dirty laundry), are sorted by hand. This is labour-intensive and prone to error, as well as being physically laborious and unhygienic.

It is also already known how to sort laundry items automatically. This can be done with the aid of data storage media assigned to the individual laundry items, such as RFID chips. But it is not always possible to sort laundry items with data storage media. Therefore, as a rule, a mixed process occurs. It also happens that data storage media cannot be read, for example because they are damaged. Such laundry items must then be sorted by hand.

BRIEF SUMMARY OF THE INVENTION

The problem which the invention proposes to solve is to create a method and a device for the at least mostly automated sorting of laundry items, e.g., for the sorting of laundry items in a mixed process, especially laundry items which are going to be washed or otherwise cleaned.

One method for the solving of this problem involves a method for sorting of laundry items, preferably laundry items for cleaning, wherein the laundry items are transportable from at least one transport system to at least one identification station and are then taken to a sorting station and sorted therein, characterized in that each time a recording is produced, in the region of the identification station or each identification station by at least one imaging device of at least some of the laundry items, at least one supplemental information item is added to the recording, and the sorting criteria for the sorting of the particular laundry item are derived in the sorting station from the recording with the at least one supplemental piece of information. According to this, at least one imaging device is provided, which creates a preferably three-dimensional recording of at least some of the laundry items. Preferably the recording is a picture. Preferably, the recording has at least one supplemental information item added to it, which supplements the information of the recording or picture produced by the at least one imaging device in order to obtain all sorting criteria needed for the automatic sorting.

Preferably the supplemental information is information not emerging from the recording or picture produced by the at least one imaging device, yet being characteristic of the laundry item of the particular recording or picture.

The critical sorting criteria are known from the recording or picture coming from the at least one imaging device, preferably three-dimensional and/or coloured, together with the at least one supplemental information item, so that with this information an automatic sorting can be done in the area of the sorting station.

One advantageous modification of the method calls for storing the particular recording with the at least one corresponding supplemental information item in a database. From this database, supplemental information can be retrieved pertaining to later recordings, without them having to be acquired once again. Thus, the method enables a self learning, which after a certain learning time enables a fully automatic sorting of all or at least a majority of subsequent laundry items.

According to one advantageous embodiment of the method, not only the recordings are deposited in the database, but also in addition optionally criteria derived from the recordings. For example, the recordings can be broken down into the criteria. The criteria may be, among others, the colour, the volume, the type of fabric and/or the weight of laundry items. It is conceivable to store the criteria along with the respective recording of the database. It may also be enough to store only the criteria derived from the recordings, such as that derived by their breakdown, in the database. Preferably other criteria are also deposited in the database, such as those obtained from a subsequent weighing, a scanning of the data storage media, or obtained manually by attendants for example during later sorting of the laundry items.

Preferably it is provided to compare a respective later recording and/or the criteria derived from it for later laundry items with recordings, criteria, or the like of earlier laundry items that are stored in the database. If this comparison reveals a basic match or approximation with an older recording deposited in the database and/or criteria stored in the database, the at least one supplemental criterion associated with the older recording and/or the older criteria and also stored in the database can be automatically assigned to the particular laundry item, without having to determine the at least one supplemental criterion and store it in the database once more.

Another possible modification of the method, in the case of laundry items which are provided with at least one data storage medium, calls for reading the data from the data storage medium of the respective laundry item, preferably in the identification station. Then no recording or picture needs to be produced for such laundry items and neither is any supplemental information required, or needs to be retrieved from the database. Laundry items having data storage medium can be sorted simply by means of the sorting criteria read from the at least one data storage medium, such as a chip, and can preferably be taken directly past the at least one imaging device without a detour.

It is especially advantageous in the case of laundry items for which it is determined in the identification station that they have no data storage medium, or one which is not readable, to produce a recording or a picture with the at least one imaging device and optionally at least one piece of supplemental information is added to it. It is then only necessary to transport such laundry items not having any data storage medium or having one which is not readable past the at least one imaging device. This makes possible a fully automatic sorting of the laundry items with minimal expense, especially minimal time expense.

It is furthermore preferably possible to divert only those laundry items having no data storage medium or those whose data storage medium is not readable in the identification station and/or before to the sorting station. This is done preferably on another section of the transport system, in laundry items with no data storage medium or with nonreadable data storage media are specifically shunted and transported through the other section of the transport system.

An alternative possibility of automated sorting of laundry items with no data storage medium or with a nonreadable data storage medium calls for taking these laundry items to a storage line of the transport system, for example. This holds in particular when at least one supplemental piece of information to the picture or other recording taken by at least one imaging device or the at least one criterion derived from this is necessary. This may preferably occur in the region of the storage line representing a bypass of the transport system or the region of some other storage station. Preferably, the at least one additional criterion is manually assigned to the recording, the picture, or the at least one automatically acquired criterion of the particular laundry item in the region of the storage station or the storage line of the transport system.

But it is also conceivable to provide a side line of the transport system, on which a picture or other recording is produced by the at least one imaging device.

A device for solving the above-indicated problem is a device for sorting of laundry items, preferably laundry items for cleaning, with an identification station, a sorting station as well as a transport system for transporting the laundry items hanging on the transport system through the identification station and the sorting station, characterized in that at least one imaging device is assigned to the identification station and at least one additional station is provided for the acquisition of at least one supplemental piece of information to the recording of the particular laundry item produced by the imaging device. In this device, it is provided to assign at least one imaging device to the identification station. By the at least one imaging device it is possible to automatically acquire, directly or indirectly, at least the majority of the sorting criteria for the sorting of the laundry items.

Preferably, at least one additional station is provided, with which at least one supplemental piece of information can be acquired, so that with this piece, in combination with the recording or picture produced by the imaging device and/or at least one criterion derived from it, all sorting criteria are in hand, so that the sorting can be done automatically.

According to one preferred modification of the device, at least one side line and/or storage line is provided, which is preferably part of the transport system. At least one detection station is assigned to the at least one side line and/or storage line. The respective detection station may be a weighing device as well as, alternatively or additionally, a detection station, preferably a data entry station or identification station, in which supplemental information preferably visually acquired by an attendant can be entered manually. The at least one side line and/or storage line results in a rectifying of the sorting process, since the laundry items can practically be transported from the identification station to the sorting station on multiple tracks. For example, the laundry items can be parked in the storage line, where the detection station is located for the manual entry of supplemental information, without hindering the transport of other laundry items not requiring any manually entered supplemental information for their sorting up to and through the sorting station. This enhances the sorting performance.

Moreover, it is conceivable to provide a database for the recordings or pictures and/or criteria derived from them from the at least one imaging device. Preferably, the database also contains the supplemental information to be acquired and entered at the at least one detection station. Preferably, the respective supplemental information of a laundry item is stored in the database together with the recording or picture and/or the at least one criterion derived from this for the same laundry item. In this way, the database contains all information pertaining to the respective laundry item, so that all sorting criteria of the particular laundry item can be retrieved from the database in order to sort it automatically in the sorting station.

If a laundry keeps a customer database revealing which laundry items are currently in the possession of a customer, the current data of the customer database can be used to match up delivered worn laundry items of the particular customer with customer-specific information, such as a particular colour and/or a particular type. For example, if a customer only has yellow table cloths washed at the laundry, the criteria of colour and laundry type can be taken over from the customer database, without having to be derived again from the delivered laundry items. The data in the customer database can also be used for a plausibility check. Thus, for example, an error during the data reading or when acquiring criteria, for example if the laundry item is heavily soiled and has changed colour at least in part, can be automatically corrected. This contributes to the fast and improved determination of the criteria needed for the exact sorting.

Another advantageous embodiment of the device calls for an evaluation device, with which a recording of a particular laundry item currently produced by the imaging device and/or the at least one criterion derived from the recording can be compared to a previous recording and/or at least one criterion deposited in the memory or in a database. If a match is found with a recording, a picture or a criterion deposited in the evaluation device, the at least one supplemental piece of information pertaining to it can be assigned to laundry items being sorted, without having to acquire the respective supplemental information once more.

It is also conceivable that not all supplemental information of a laundry item present in the database will be obtained from the database, i.e., a complete matching of the laundry items is not possible. Even so, the identified criteria and/or supplemental information can serve to provide the attendant, who must manually ascertain the missing supplemental information, with a prompt which helps the attendant in determining the missing supplemental information.

BRIEF DESCRIPTION OF THE DRAWINGS

Preferred sample embodiments of the invention shall be explained more closely below with the aid of the drawing. The figures in the drawing show.

DETAILED DESCRIPTION OF PREFERRED EMBODIMENTS

Figure 1:
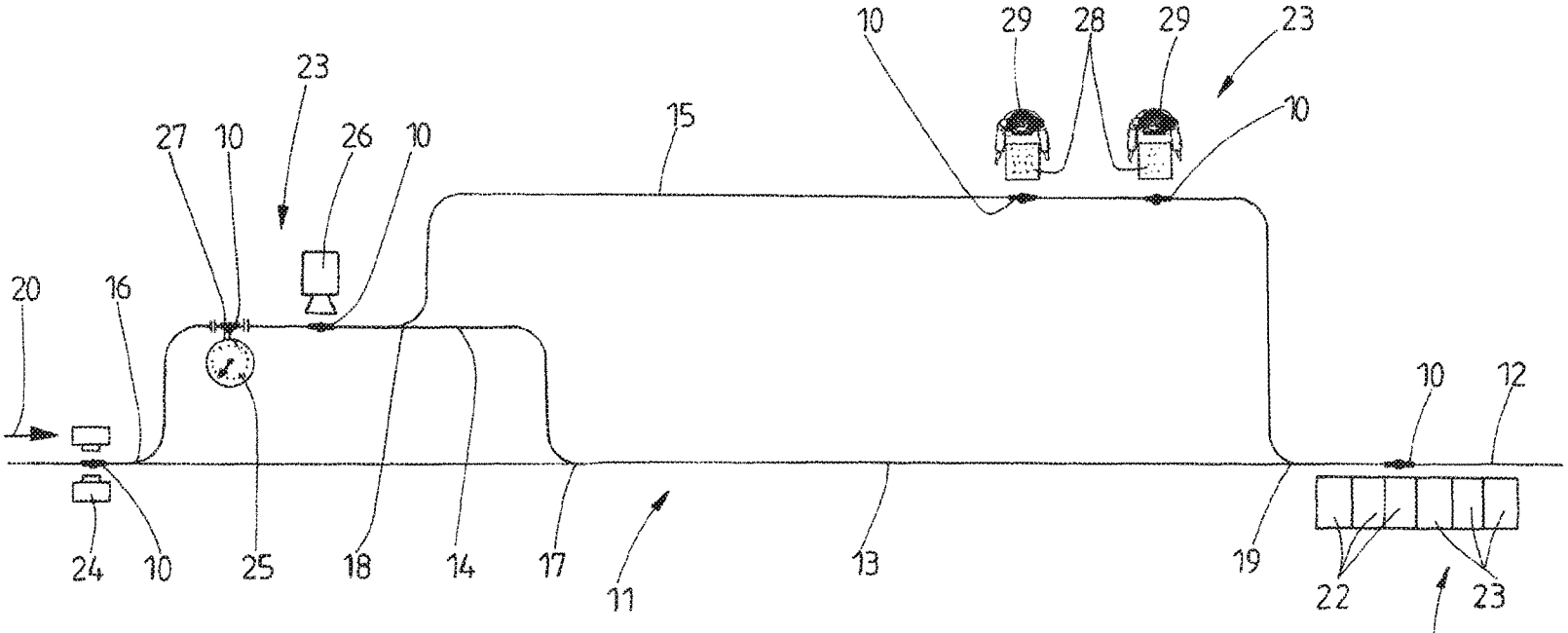
FIG. 1 is a schematic top view of a device according to a first sample embodiment of the invention.

The schematically represented devices serve for the sorting of laundry items to be washed or otherwise cleaned, so-called dirty laundry, at commercial laundry establishments. For reasons of a simplified representation, only a few laundry items 10 are shown symbolically in the drawings, in fact only one laundry item 10 at each of the individual stations.

The device of FIG. 1 has a transport system 11, of which FIG. 1 shows only a delivery section 12. The delivery section 12 of the transport system 11 has a track with trolley cars able to move on or in it through an encircling delivery line. A plurality of identical trolley cars moves in succession, preferably with the same slight spacing from each other. The spacings are chosen so that laundry items 10 are slightly spaced apart from each other among neighbouring trolley cars, so that they do not touch each other or overlap. On each trolley car, a transport hanger can be detachably secured. The respective transport hanger carries a laundry item 10 hung on it. But it is also conceivable to provide the trolley cars with at least one clamp, in which a laundry item 10 is in each case clamped in preferably a spread-out condition.

The respective transport hanger may comprise a transponder, such as an RFID transponder. The data read from the data storage medium of the laundry item 10 is then added electronically to the transponder of the transport hanger, so to speak married to it. In the further course of the sorting or acquisition, still missing criteria and/or supplemental information then only needs to be read from the transponder of the transport hanger, which is easier than reading data from the data storage medium of the particular laundry item, which might be covered up in the further course of the transport system.

FIG. 1 shows as an example one possible layout of the delivery section 12. Accordingly, this has a continuous main line 13, a side line 14 branching off from it, and a rather long storage line 15. The side line 14 branches off from the main line 13 in the region of a shunt 16 and again returns to the main line 13 in the region of a second shunt 17. The storage line 15 branches off from the side line 14 at a third shunt 18 and at the end is again returned to the main line 13 at a fourth shunt 19. The storage line 15 has a substantially longer length as compared to the side line 14. In particular, the storage line 15 may also be longer than represented in FIG. 1, for example, thanks to a winding route. In this way, the storage line 15 serves as a buffer storage, in which laundry items 10 may be assembled before being shunted to the main line 13.

The invention is not limited to the above described embodiment of the delivery section 12 and/or its route. Instead, the delivery section 12 may have any other configuration, especially one adapted to the needs of the particular laundry establishment. It is also conceivable for the delivery section 12 to have only one main line 13, only one main line 13 and one side line 14 or only one main line 13 and a storage line 15. Furthermore, several side lines 14 and/or storage lines 15 may also be provided.

The laundry items 10 are further transported in the transport direction 20 of the transport system 11. The transport direction 20 may therefore also be called the sorting direction. In terms of FIG. 1, the laundry items 10 being sorted are supplied at the left side and the sorting process ends at the right side with a deliberate dropping or laying down of the laundry items 10 according to their sorting criteria in a sorting station 21. Alternatively or additionally, the laundry items 10 of the same type can also be buffered and/or temporarily stored on storage tracks.

The sorting station 21 is only schematically indicated in FIG. 1 by compartments 22 arranged on one side next to the end of the main line 13. Merely as an example, FIG. 1 shows six compartments 22 of roughly the same size. However, this sorting station 21 may have a larger or smaller number of compartments 22. The compartments 22 may also be arranged on both sides of the end of the main line 13. The compartments 22 may be, for example, laundry carts, laundry bags, or other containers for recording a large number of laundry items 10 meeting the same sorting criteria.

In front of the sorting station 21 in the device shown in FIG. 1 there are several identification stations or one identification station 23 with different identification devices.

At the beginning of the delivery section 12, namely, of its main line 13, the identification station 23 comprises at least one preferably noncontact-type data reader 24. The data reader 24 serves for reading the data needed for the automatic sorting of the laundry items 10 from a data storage medium of such laundry items 10 having a data storage medium. Alternatively, two data readers 24 may also be provided, in order to read out data from data storage media of the laundry items 10 and/or the transport hangers carrying the laundry items 10.

In the case of laundry items 10 not having any data storage medium or whose data storage medium cannot be read by the data reader 24, the identification station 23 has further identification devices which are associated with the side line 14 and the storage line 15 represented in FIG. 1.

Two identification devices in the sample embodiment shown are assigned to the side line 14, namely, a scale 25 and an imaging device preferably designed as a 3D-camera 26. The 3D-camera 26 is designed to produce a three-dimensional image or three-dimensional picture of the respective laundry item 10 transported past it. Preferably, this is a colour three-dimensional picture or image in each case. The scale 25 carries a short line segment 27 of the side line 14. This line segment 27 is separated from the delivery track of the side line 14, so that the scale 25 can determine the weight of the laundry item 10 present in the line segment 27 with the weight of the line segment 27. The separation of the line segment 27 from the side line 14 is such that the trolley cars moving on the delivery track can substantially arrive with no transition at the line segment 27 and be transported once again from it to the side line 14.

In the sample embodiment shown in FIG. 1, the 3D-camera 26 looking in the transport direction 20 is arranged behind the scale 25. But the 3D-camera 26 can also be provided in front of the scale 25. It is also conceivable to provide only a 3D-camera 26, and thus no scale 25, or only a scale 25.

The storage line 15 in the sample embodiment shown is provided with two successive manual identification stations, preferably of the same design, for supplemental information needed for the sorting of the laundry items 10. The supplemental information preferably involves sorting criteria not derivable or ascertainable from the criteria obtained in the respective recording of the 3D-camera 26 and/or from the weight as determined by the scale 25.

Each manual identification station has a data entry panel 28, such as a keypad, which is assigned an attendant 19. In the device depicted in FIG. 1, the manual identification stations are placed in succession at the end of the storage line 15. But the manual identification stations can also be located at other places of the storage line 15. It is also conceivable to provide only one or more than two manual identification stations at the storage line 15. The respective identification station can also be provided decentralized at another location. Pictures of the laundry items 10 are then transmitted to the at least one decentralized identification station.

The length of the storage line 15 is chosen such that a plurality of garments hanging on trolley cars are accommodated here at the same time, so that the storage line 15 serves as a buffer. This buffer is necessary, because the manual entry of the at least one supplemental piece of information per laundry item 10 takes more time than the automatic acquisition of the sorting criteria by the data reader 24, the scale 25 and/or the 3D-camera 26. In order to avoid a traffic jam in front of the particular identification station, split-up and/or multitrack storage lines 15 or circular storage sections can also be provided.

If only laundry items 10 need to be sorted whose sorting criteria can either be read by the data reader 24 or—if data storage media are lacking or unreadable on the laundry items 10—ascertained by the 3D-camera 26 and/or the scale 25, the device requires no manual data entry station, i.e., no data entry panel 28, and also generally no storage line 15. Neither is an attendant 29 needed for the sorting, so that such a device enables a fully automatic sorting of the laundry items 10, including laundry items 10 having no data storage medium or whose data storage medium is unreadable.

In the following, the method according to the invention shall be described with the aid of the above-described device per FIG. 1:

The method is characterized in that a recording or a picture of the respective laundry item 10 hanging beneath the transport system 11 is produced in the region of the identification station 23 by the 3D-camera 26 or some other imaging device and criteria for the sorting are derived from this. If not all sorting criteria of the laundry item 10 can be derived from the recording or the picture and/or the criteria derived from the latter, as are needed for the sorting, at least one supplemental piece of information with the at least one lacking sorting criterion, is added to the information derived from the recording or the picture, especially sorting criteria, preferably in the identification station 23, and/or missing information from a database is compared and/or supplemented with data on laundry items 10 of a clientele. The supplemental information may be the weight of the particular laundry item 10 registered by the scale 25. If the weight alone is sufficient, the respective laundry item can be sorted by means of the automatically recorded sorting criteria by separation from the transport system 11, namely the main line 13, at the corresponding compartment 22 of the sorting station 21.

If the laundry items 10 are provided with a data storage medium, which generally contains all sorting criteria needed for the automatic sorting, these are read in a noncontact manner by at least one data reader 24 at the start of the main line 13 of the transport system 11 from the data storage medium on the laundry item 10 and/or a data storage medium of the transport hanger carrying the laundry item 10. The data then goes to a control system of the transport system 11, which controls the transport system 11 so that the respective laundry item 10 is positioned at the compartment 22 of the sorting station 21 corresponding to the sorting criteria acquired by the data reader 24. Thus, there is a fully automatic sorting of laundry items 10 with a data storage medium whose data is readable by the data reader 24.

In the case of laundry items 10 not having a data storage medium, or a readable data storage medium, this is determined by the data reader 24 at the start of the main line 13. The control system of the device then activates the shunt 16 at the start of the side line 14 which will take the trolley car with the respective laundry item 10 hanging from it to the side line 14 of the transport system 11. In the further transport of this laundry item 10 along the side line 14, the laundry item 10 is first weighed by the scale 25 and then the 3D-camera 26 produces a three-dimensional and preferably colour recording or picture of the laundry item 10 spread out and hanging on the transport system 11. The recording or picture, preferably the data thereof, is relayed by the 3D-camera 26 just like the weight of the laundry item 10 previously determined by the scale 25 to the control system of the device.

The recordings or the recording data or picture date of the 3D-camera 26 contain at least the outlines or the contour, i.e., the shape, of the laundry item 10, but preferably also the colour, the surface structure, the surface curvature and/or the topography of the laundry item 10. The weight of the laundry item as recorded by the scale 25 may also constitute a supplemental information item.

If all sorting criteria serving for the automatic sorting of the laundry item 10 emerge from or can be ascertained from the data or criteria of the recording or picture of the laundry item 10 produced by the 3D-camera 26, possibly together with the supplemental information of the weight of the laundry item 10 as determined by the scale 25, for example by a computer associated with the control system of the device, the respective laundry item 10 is shunted directly out from the side line 14 in the region of the shunt 17 and thereby returned to the main line 13, from which the laundry item 10 is transported to the sorting station 21 and automatically sorted there by handing off to the compartment 22 provided for the sorting criteria of the particular laundry item 10. Prior to the handoff, all the sorting criteria may undergo a plausibility checking and/or polling.

If the 3D camera 26 is only assigned to the side line 14, but not any scale 25, the laundry items 10 will then only be transported back to the main line 13 from the side line 14 immediately after producing a recording, especially a three-dimensional recording, if the data which can be derived from the recording, especially three-dimensional data, of the respective laundry item 10 contain all required sorting criteria or can be optionally derived therefrom by computation.

If not all sorting criteria needed for an acceptable sorting can be derived for a laundry item 10 without a data memory or with a nonreadable data memory from the recording of the 3D-camera 26 and possibly also from the weight of the laundry item 10 as determined by the scale 25, at least one supplemental piece of information is added manually to the recording produced by the 3D-camera 26 and possibly to the weight as determined by the scale 25 so as to obtain all sorting criteria needed for the sorting in this way. The at least one manually generated piece of supplemental information also goes to the control system of the device and is saved in the database the same as the image data of the recording of the particular laundry item 10 and possibly the weight of the laundry item 10.

The at least one supplemental criterion is entered manually by two attendants 29 in the sample embodiment depicted in the data entry panel 28 assigned to them. This is done along the storage line 15. Since the manual entry in each case of the at least one piece of supplemental information takes more time than the automatic detection of the sorting criteria by the 3D-camera 26 and/or the scale 25, the storage line 15 is longer than the side line 14, for example. In this way, the storage line 14 serves as a buffer.

After the at least one piece of supplemental information has been entered manually by the attendants 29 in the data entry panels 28, it is associated in the control system or the database of the device with the previously taken picture or the recording as well as optionally the weight of the same laundry item 10 and saved together with them in the database. All sorting criteria for the laundry items on the storage section 15 are then deposited in the control system, especially in its data memory, so that the laundry items can then be transported back from the storage line 15 to the main line 13 and travel along the main line 13 through the sorting station 21, where the respective laundry item 10 is sorted in accordance with the sorting criterion or sorting criteria of the at least one manually entered piece of supplemental information by handoff to a compartment 22 of the sorting station 21 that corresponds to the sorting criteria of the respective laundry item 10.

The control system of the device contains a program for comparing the criteria saved in the database, which are derived from the recorded images or pictures taken of previously sorted laundry items 10 and possibly also the weight of the laundry item 10 saved for this. During this comparison with the criteria of the recordings deposited in the database, it is determined whether at least some saved criteria of previous recordings or pictures match up with criteria of the currently produced recording of the subsequent laundry item 10. These matches need not necessarily be exact, they may lie within certain predetermined tolerance ranges. The same holds for the weight, if a determination of this is specified. Preferably, the criteria ascertained manually at the respective identification station are also added to or saved in the database with the data record of the respective laundry item 10 and then the sorting is undertaken.

If a match is found upon comparing a previous recording deposited in the database with a current recording, the at least one supplemental piece of information, especially manually acquired supplemental information which is deposited in the data memory for the matching recording, in particular is assigned to it, is assigned to the current recording of the laundry item 10 yet to be sorted. The at least one piece of supplemental information then does not need to be acquired once more for the laundry item 10 currently being sorted. This laundry item 10 then does not need to move through the storage line 14 again. Instead, it can be shunted directly from the side line 14 back to the main line 13 and this laundry item 10 can thereby be sorted automatically in the sorting station 21.

If it is determined in the above-described comparison that no recording has been saved in the data memory that corresponds to the current recording now taken for a laundry item 10 which is yet to be sorted, this item is taken to the storage line 15, where at least one piece of supplemental information is manually determined for this laundry item 10 and saved as a new data record in the data memory together with the image of this laundry item 10.

The above-described procedure for the comparison of available images in the database with currently recorded images of laundry items 10 yet to be sorted results in a kind of "self learning process". As a result, with increasing number of images saved in the database with the at least one corresponding piece of supplemental information, subsequent laundry items can also be sorted automatically whose recordings do not yet contain all the sorting criteria.

The method and the device have been described above in connection with the 3D-camera 26 for producing three-dimensional recordings or pictures. The 3D-camera 26 is preferably one which produces the three-dimensional colour recording or a three-dimensional colour picture, so that the 3D-camera 26 also provides the colour of the particular laundry item as a sorting criterion. Instead of a 3D-camera, several 2D-cameras may also be used, which produce only two-dimensional recordings, whereupon a suitable evaluation electronics produces from the two-dimensional recordings of several two-dimensional cameras a three-dimensional recording or a three-dimensional picture. This recording or this picture is preferably a colour picture, in that at least one of the 2D-cameras is designed as a colour camera (RGB).

The respective trolley car or its hook, its clamp, or the transport hanger attached to it is assigned an identification feature, such as an address or an individual number. The control system of the transport system 11 is also oriented to this in the transporting of the laundry items 10 through the transport system 11 and the positioning at particular places of the transport system 11, especially in the transporting through the identification station 23 and the sorting station 21. Preferably, the address or numbering of each trolley car carrying a laundry item 10 or some other component of the control system is assigned to the ascertained sorting criteria, especially the image of the particular laundry item 10, the corresponding weight and/or the at least one corresponding piece of supplemental information, so that it is always known where in the delivery section 12 a laundry item 10 with particular sorting criteria is to be found. Then the automatic sorting of the particular laundry item 10 can occur by handing off to the respective compartment 22.

Alternatively, it is conceivable to save the sorting criteria derived from the recording of each laundry item 10 and the at least one piece of supplemental information and possibly the weight of the laundry item 10 on or in the trolley cart carrying it or some other component of the transport system 11 and read them out in the sorting station 21. If it is determined during this reading that a particular laundry item 10 has sorting criteria which match the sorting criteria assigned to a particular compartment 22, the laundry item 10 will be automatically taken to this compartment 22 of the sorting station 21.

Figure 2:
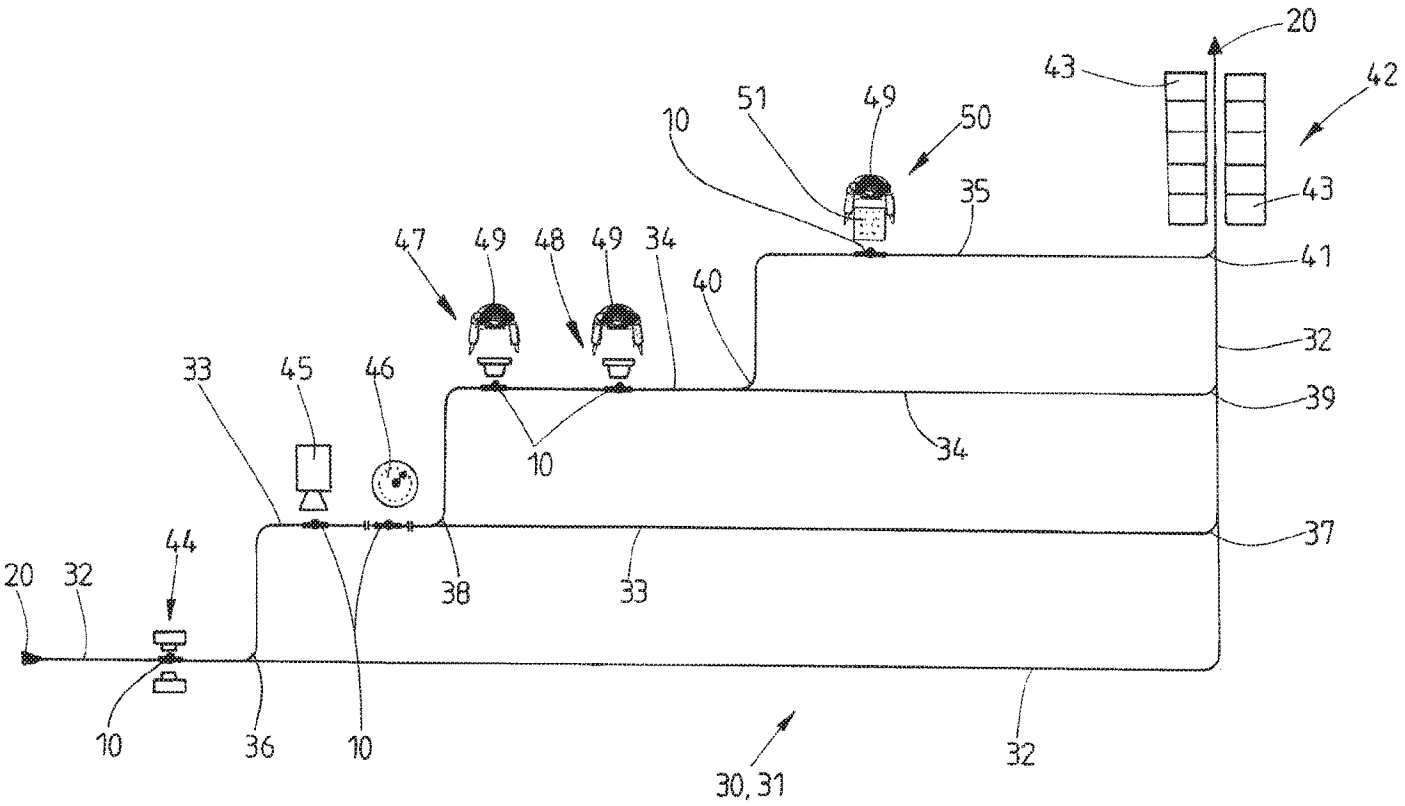
FIG. 2 is a second sample embodiment of the invention in a schematic top view similar to FIG. 1.

FIG. 2 shows the second sample embodiment of the device according to the invention, which preferably also serves for carrying out the method according to the invention. This device has a transport system 30 which is designed like the transport system 11 of the device in FIG. 1. The course of the delivery section 31 of the transport system 30 differs from the delivery section 12 of the sample embodiment of FIG. 1. The delivery section 31 of FIG. 2 has a continuous main line 32 and three partly parallel side lines 33, 34 and 35 running alongside each other. The number of side lines 33 to 35 may also be larger or smaller. The first side line 33 branches off from the main line 32 in the region of a shunt 36. One end of the side line 33 is returned at a second shunt 37 to the main line 32. The second side line 34 branches off from the first side line 33 at a shunt 38. The side line 34 returns to the main line 32 at a shunt 39. Finally, the third side line 35 branches off from the side line 34 at a shunt 40. The side line 35 returns to the main line 32 at a shunt 41. The side lines 33 to 35 have a larger length than necessary. In this way, the side lines 33 to 35, especially the longer side lines 32 and 33, may serve as buffers for a relatively large number of laundry items 10 yet to be sorted.

The laundry items 10 are also transported further along the delivery section 31 of the transport system 30 in the transport direction 20. The transport direction 20 corresponds here to the sorting direction of the laundry items 10.

A sorting station 42 at the end of the main line 32 of the transport system 30 is also shown only schematically in FIG. 2. Symbolically, ten roughly equal compartments 43 of the sorting station 42 are represented in FIG. 2. These are distributed on both sides of the end of the main line 32. But the sorting station 42 may also have a larger or smaller number of compartments 43 or a different configuration.

Looking in the transport direction 20, there are several identification stations located upstream from the sorting station 42 also in the device of FIG. 2.

At the start of the delivery section 31, namely the main line 32 thereof, there is located an identification station which is designed as a noncontact type data reader 44. The data reader 44 has the same function and works in the same way as the data reader 24 described above in connection with the sample embodiment of FIG. 1.

Further identification stations with different identification devices are provided for laundry items 10 not having a data storage medium or whose data storage medium is unreadable by the data reader 44, being associated in the device of FIG. 2 with the side lines 33, 34 and 35.

In the exemplary embodiment of FIG. 2 identification stations or identification devices are designed as a 3D-camera 45 and a scale 36, which are associated with the side line 33. The 3D-camera 45 is preferably designed as a three-dimensional colour camera. Looking in the transport direction 20, the 3D-camera 45 is followed at a short distance by the scale 46.

The 3D-camera 45 and the scale 46 in the sample embodiment of FIG. 2 are designed exactly the same as in the sample embodiment of FIG. 1. Therefore, reference is made to the description given in connection with FIG. 1 for the 3D-camera 26 and the scale 25.

After the 3D-camera 45 and the scale 46 comes the shunt 38, which can take the laundry items 10 from the first side line 33 to the second side line 34. Because the scale 46 and the 3D-camera 45 are arranged before this shunt 38, all the laundry items 10 which are supposed to be transported further along the side lines 33, 34 and 35 run past both of them.

The second side line 34 in the sample embodiment shown is associated with two additional consecutive identification stations, being manual identification stations 47 and 48. Each manual identification station 47 and 48 is designed as a workstation for an attendant 49. The identification stations 47 and 48 each have a data entry panel, for example a keypad, and possibly a monitor screen. At the data entry panel, the respective attendant 49 can enter by hand any manually acquired supplemental information, being preferably at least one manually determined sorting criterion. It is conceivable to provide a camera at the manual identification stations 47 and 48, which produces a picture of the respective laundry item 10 at the identification station 47 and 48 and transmits this to a monitor screen at another location, such as an office room. The respective attendant 49 can then enter in a decentralized manner each sorting criterion determined manually with the aid of the picture shown on the monitor in the keypad of the data entry panel. In this way, the attendants 49 do not need to be located directly at the transport system 30; instead, they may be distant from the transport system 30, for example in a noise-protected environment or a noise-protected room, where they can determine the respective supplemental information as an additional sorting criterion and enter it in their data entry panel.

The laundry items 10 which have moved past the manual identification stations 47 and 48, if all supplemental information has been successfully entered at the manual identification stations 47 and 48, move through the second side line 34 and at the end of it are taken from the shunt 39 to the main line 32, namely, upstream from the sorting station 42.

Those laundry items 10 for which not all the supplemental information or sorting criteria could be determined at the manual identification stations 47 and 48 are taken at the shunt 40 to the third side line 35. At the third side line 35 in the sample embodiment shown there is provided another manual identification station 50 with an attendant 49. The manual identification station 50 has a data entry panel 51. The supplemental information manually determined by the attendant 49 for the laundry item 10 presently located at the manual identification station 50 is then entered by the attendant in the data entry panel 51. The attendant 49 at the manual identification station 50 ascertains supplemental information which could not be determined by the attendant 49 at the manual identification stations 47 and 48, for example because it is more complex and therefore requires an attendant 49 with more experience. Therefore, the last manual identification station 50 can also be called an expert station 50.

All supplemental information ascertained by the attendants 49 at the manual identification stations 47, 48 and 50 is in particular additional sorting criteria which are also saved in the database, and this together with such information and/or criteria previously determined automatically by the data reader 44, the 3D-camera 45 and/or the scale 46 and has also been saved in the database for the particular laundry item 10.

The method according to the invention takes place with the device represented in FIG. 2 and described above in basically the same way as the device represented in FIG. 1. Consequently, reference is made in full to the description of the method according to the invention in connection with the device of FIG. 1.

The above described method and the device call for all or at least some of the laundry items 10 to have data storage media with sorting criteria. But the invention is also suitable for the automatic sorting of laundry items 10 without data storage media. In that case, a preferably three-dimensional and especially also a colour image is generated for all laundry items 10, from which criteria are obtained which represent at least a majority of the sorting criteria and any missing sorting criteria are deposited together with the corresponding image in the database, for example by manual entry of at least one piece of supplemental information, from which the missing sorting criterion or criteria can be derived.

Once the database contains a sufficient number of data records with criteria obtained from recordings or pictures and supplemental information, it may be sufficient for the automatic sorting of subsequent laundry items 10 with or even without data storage media to only produce recordings of the laundry items 10 by an imaging device and to derive from them criteria for the sorting of the laundry items, in order to obtain the supplemental information pertaining to the particular laundry item from the database, without having to again determine it manually, for example.

The criteria of the respectively currently recorded laundry item derived from the recordings or pictures of the 3D-cameras 26, 45 are compared with criteria of earlier laundry items 10 saved in the database. If recorded criteria of a laundry item 10 match the criteria of a laundry item already saved in the database, at least approximately, in that the criteria are the newly recorded criteria within a determinable tolerance range of the criteria saved for a laundry item 10, this points to the same or a similar laundry item 10. Then the further sorting criteria or supplemental criteria saved for this laundry item 10 which belong to the comparable laundry item 10 found in the database are taken over from the database. In this way, the additional criteria or additional sorting criteria for the sorting of the laundry items 10 do not need to be determined otherwise, in particular, no longer at the manual identification stations 47, 48 and/or 50. The larger the data volume present in the database, the greater the likelihood of finding a match with a laundry item 10 already saved in the database. Thus, with increasing data volume, fewer and fewer additional criteria and additional sorting criteria need to be determined, in particular, in time the manual determination of criteria not automatically determinable diminishes on account of the constantly growing data volume in the database.

LIST OF REFERENCE SYMBOLS

10 Laundry item
11 Transport system
12 Delivery section
13 Main line
14 Side line
15 Storage line
16 Shunt
17 Shunt
18 Shunt
19 Shunt
20 Transport direction
21 Sorting station
22 Compartment
23 Identification station
24 Data reader
25 Scale
26 3D-camera
27 Line segment
28 Data entry panel
29 Attendant
30 Transport system
31 Delivery section
32 Main line
33 Side line
34 Side line
35 Side line
36 Shunt
37 Shunt
38 Shunt
39 Shunt
40 Shunt
41 Shunt
42 Sorting station
43 Compartment
44 Data reader
45 3D-camera
46 Scale
47 Manual identification station
48 Manual identification station
49 Attendant
50 Manual identification station
51 Data entry panel

What is claimed is:

1. A method for sorting of laundry items (10), wherein the laundry items (10) are transportable from at least one transport system (11) to at least one identification station (23) and are then taken to a sorting station (21) and sorted therein, comprising:

determining in the identification station (23) whether the laundry items (10) have a data storage medium or have a readable one of the data storage medium and, for those of the laundry items (10) that have the data storage medium or have a readable one of the data storage medium, reading in the identification station (23) data of the laundry items (10) from the at least one of the data storage medium provided on the laundry items (10);

producing a recording using at least one imaging device of at least some of the laundry items (10) for which it is determined in the at least one identification station (23) do not have the data storage medium or do not have a readable one of the data storage medium;

each time a recording is produced, in the region of the at least one identification station (23) by the at least one imaging device of a particular one of the at least some of the laundry items (10), adding at least one supplemental piece of information to the recording; and deriving sorting criteria for the sorting of the particular one of the laundry items (10) in the sorting station (21) from the recording with the at least one supplemental piece of information.

2. The method according to claim 1, wherein the at least one supplemental piece of information is obtained manually and/or by weighing of the particular one of the laundry items (10).

3. The method according to claim 1, wherein the recording is a three-dimensional recording and/or a color recording.

4. The method according to one claim 1, wherein the recording with its corresponding at least one supplemental piece information is saved in a database and/or the later recordings of subsequent laundry items (10) taken by the at least one imaging device are compared to recordings in the database and if a later taken recording agrees at least basically with one of the recordings present in the database the at least one supplemental piece of information saved in the database together with the one of the recordings present in the database is assigned to the later recording.

5. The method according to claim 1, wherein those of the laundry items (10) that do not have the data storage medium or do not have a readable one of the data storage medium are led and/or shunted in the identification station (23) and/or before the sorting station (21) into at least one other segment of the transport system (11).

6. The method according to claim 1, wherein those laundry items (10) that do not have the data storage medium or do not have a readable data storage medium are taken to a buffer station, the buffer station being at least one storage line (15) and/or side line (14) of the transport system (11).

7. The method according to claim 6, wherein at least one additional criterion of the laundry items (10) is determined manually and/or automatically in the at least one storage line (15) and/or side line (14) and the at least one additional criterion obtained in this way is assigned to the recording of the particular one of the laundry items.

8. The method according to claim 1, wherein criteria for the sorting of a respective one of the laundry items (10) are derived from the recording of the respective one of the laundry items (10).

9. The method according to claim 1, wherein criteria for the sorting of a respective one of the laundry items (10) are derived from the recording of the respective one of the laundry items (10) by automatic breakdown of the recording.

10. The method according to claim 1, wherein criteria for the sorting of a respective one of the laundry items (10) are derived from the recording of the respective one of the laundry items (10) by automatic breakdown of the recording by an image evaluation and/or the criteria are saved in a database.

* * * * *